US006913516B1

(12) United States Patent
Wang et al.

(10) Patent No.: US 6,913,516 B1
(45) Date of Patent: Jul. 5, 2005

(54) DUMMY PROCESS AND POLISHING-PAD CONDITIONING PROCESS FOR CHEMICAL MECHANICAL POLISHING APPARATUS

(75) Inventors: Ta-Jen Wang, Hsinchu (TW); Chi-Hao Chuang, Hsinchu (TW); Cheng-Hsiang Wu, Taichung (TW)

(73) Assignee: Powerchip Semiconductor Corp., Hsinchu (TW)

( * ) Notice: Subject to any disclaimer, the term of this patent is extended or adjusted under 35 U.S.C. 154(b) by 0 days.

(21) Appl. No.: 10/710,508

(22) Filed: Jul. 16, 2004

(30) Foreign Application Priority Data

Feb. 2, 2004 (TW) ..... 93102263 A

(51) Int. Cl.[7] ..... B24B 1/00
(52) U.S. Cl. ..... 451/11; 451/72; 451/285
(58) Field of Search ..... 451/11, 56, 72, 451/285, 286, 287, 288, 290, 41, 63

(56) References Cited

U.S. PATENT DOCUMENTS 5,428,555 A * 6/1995 Starkey et al. ..... 700/275
6,149,507 A * 11/2000 Lee et al. ..... 451/66
6,743,080 B2 * 6/2004 Truong ..... 451/56

* cited by examiner

*Primary Examiner*—Jacob K. Ackun, Jr.
(74) *Attorney, Agent, or Firm*—Jianq Chyun IP Office

(57) ABSTRACT

A dummy process and a polishing-pad conditioning process suitable for a chemical mechanical polishing (CMP) is provided. The CMP apparatus includes a polishing head, a polishing table, and a polishing pad. The polishing head includes a protective hood, a base, a retaining ring and a wafer supporting assembly. The wafer is attached to an attaching surface in the wafer receiving recess. Next, the wafer supporting assembly is moved to make the bottom surface of the retaining ring more protrusive than the bottom surface of the wafer such that the wafer does not contact the surface of the polishing pad. Accordingly, the need for a large number of dummy wafers can be effectively avoided.

16 Claims, 5 Drawing Sheets

DUMMY PROCESS AND POLISHING-PAD CONDITIONING PROCESS FOR CHEMICAL MECHANICAL POLISHING APPARATUS

CROSS REFERENCE TO RELATED APPLICATIONS

This application claims the priority benefit of Taiwan application serial no. 93102263, filed Feb. 2, 2004.

BACKGROUND OF INVENTION

1. Field of the Invention

The present invention generally relates to a chemical mechanical polishing (CMP) process, and more particularly to a dummy process and a polishing-pad conditioning process suitable for a CMP apparatus.

2. Description of Related Art

With continuous reduction in size of semiconductor devices, resolution of photolithographic exposure in semiconductor fabrication processes has been enhanced, and consequently, with decrease of depth-of-focus of exposure, requirements on smoothness of the surface of wafers has accordingly become more stringent. Typically, planarization of wafers is usually accomplished in a CMP process. CMP process have a distinctive feature of anisotropic polishing and thus is suitable not only for planarization on outer surface of wafers but also for fabrication of inlay structures of metal interconnects, shallow trench isolation, micromechanical and electrical systems, and plane monitors.

In a CMP process, a wafer is usually fixed on a polishing head with the surface of the wafer to be polished facing the rotating polishing pad. Next, polishing slurry consisting of abrasive particles and chemical agents is provided on the polishing pad. Next, the polishing head is then made to come in contact with the wafer surface, and a suitable pressure is applied onto the wafer to press the wafer firmly on the polishing pad. The polishing of the wafer surface effected by the chemical reactions between the wafer surface and the polishing slurry and the mechanical abrasive action between wafer surface, the abrasive particles of the polishing slurry and the polishing pad. Thus, a CMP process to obtain a planar surface with smooth topography.

FIG. 1 shows relative position and interaction between a polishing head and wafer in a conventional CMP process. Typically, a conventional polishing head 100 includes a protective hood 102, a base 104, a retaining ring 106, and a wafer supporting assembly 108. The base 104 is below the protective hood 102, the wafer supporting assembly 108 is below the base 104, and the retaining ring 106 is fixed around the rim of the base 104. Wherein, a wafer supporting assembly 108 includes a supporting board 110 and a membrane 112 connecting the supporting board 110, while the membrane 112 connects with and extends under the supporting board 110 to provide an attaching surface 114 for the wafer 10.

During the CMP process, a wafer 10 is placed under the attaching surface 114 and a pressure is applied onto the base 104 so that the wafer supporting assembly 108 moves down to firmly contact with the wafer 10. Next, the wafer 10 held by the polishing head 100 is moved onto a surface of the polishing pad 122 attached to a polishing table 120. Next, the wafer and the polishing pad are rotated relative each other such that the wafer is held against the surface of the polishing pad under pressure. In other words, the hollow chamber 116 between the base 104 and the wafer supporting assembly 108 is under pressure, and consequently, an upward force 132 is applied onto the base 104 and a downward force 134 is applied onto the wafer supporting assembly 108. Hence, the downward force 134 on the wafer supporting assembly 108 will press the wafer 10 onto the polishing pad 122. Then, the polishing table 120 can be rotated relative to the polishing head 100 for planarizing the wafer surface.

When a CMP polisher is idle, a dummy process is usually performed to keep the polishing pad under a stable condition. The dummy process is identical to a CMP process (shown in FIG. 1) except the wafer is replaced with a dummy wafer. Therefore, a large number of dummy wafers are required for maintaining a conventional CMP apparatus, and these dummy wafers must be coated with a membrane prior to its use in a dummy polishing process.

Apparently, a large number of dummy wafers are required, which would undoubtedly increase the costs of the already expensive CMP process.

SUMMARY OF INVENTION

In view of the above, the present invention is directed to a dummy process suitable for a CMP apparatus for substantially reducing production cost.

The present invention is also directed a polishing-pad conditioning process suitable for a CMP apparatus for reducing production cost of the CMP process.

According to an embodiment of the present invention, a dummy process for a CMP process is provided. The CMP apparatus comprises a polishing head, a polishing pad attached to a polishing table. The polishing head includes a protective hood, a base, a retaining ring and a wafer supporting assembly. The base is below the protective hood, the retaining ring is fixed around the rim of the base, the wafer supporting assembly is located below and in a distance from the base, and a wafer receiving recess is defined by an inner surface of the retaining ring and the wafer supporting assembly. According to an embodiment of the present invention, the dummy process includes providing a wafer, attaching the wafer to the wafer receiving recess, and then moving up the wafer supporting assembly to make the bottom surface of the retaining ring more protrusive than the bottom surface of the wafer. Next, the polishing head is moved onto polishing pad on the polishing table by pressing down the base to let the retaining ring contact the polishing pad such that the wafer does not contact the polishing pad. Next, the polishing table is rotated.

According to an embodiment of the present invention, the base can be a dummy wafer or other sheet-like substrate for protecting a wafer supporting assembly.

According to an embodiment of the present invention, a polishing-pad conditioning method for a CMP apparatus is provided. The polishing-pad conditioning method is suitable for a CMP apparatus including a conditioner, a polishing head, a polishing table and a polishing pad. The polishing pad is disposed on the polishing table, the polishing head includes a protective hood, a base, a retaining ring and a wafer supporting assembly, wherein the base is below the protective hood, the retaining ring is fixed around the rim of the base, the wafer supporting assembly is located below and in a distance from the base, and a wafer receiving recess is defined by an inner surface of the retaining ring and the wafer supporting assembly. According to an embodiment of the present invention, the polishing-pad conditioning method includes attaching the wafer to the wafer receiving recess, and then moving up the wafer supporting assembly to make the bottom surface of the retaining ring more protrusive than the bottom surface of the wafer. Next, the polishing head and the conditioner are moved onto the polishing pad on the polishing table allowing the conditioner to contact the polishing pad by pressing down the base of the polishing head such that the retaining ring contact the polishing pad and the wafer does not contact the polishing pad. Next, the polishing table is rotated to condition the contour of the polishing pad.

In summary, according to an embodiment of the present invention, because the positions of the retaining ring fixed on the rim of the base and the wafer are controlled in a manner that the retaining ring contacts the polishing pad and the wafer does not contact the polishing pad, and therefore a need for a large number of dummy wafers during the dummy process or the process of polishing-pad conditioning process can be effectively avoided. Therefore, the production cost can be significantly reduced.

It is to be understood that both the foregoing general description and the following detailed description are exemplary, and are intended to provide further explanation of the invention as claimed.

DETAILED DESCRIPTION

Figure 1:
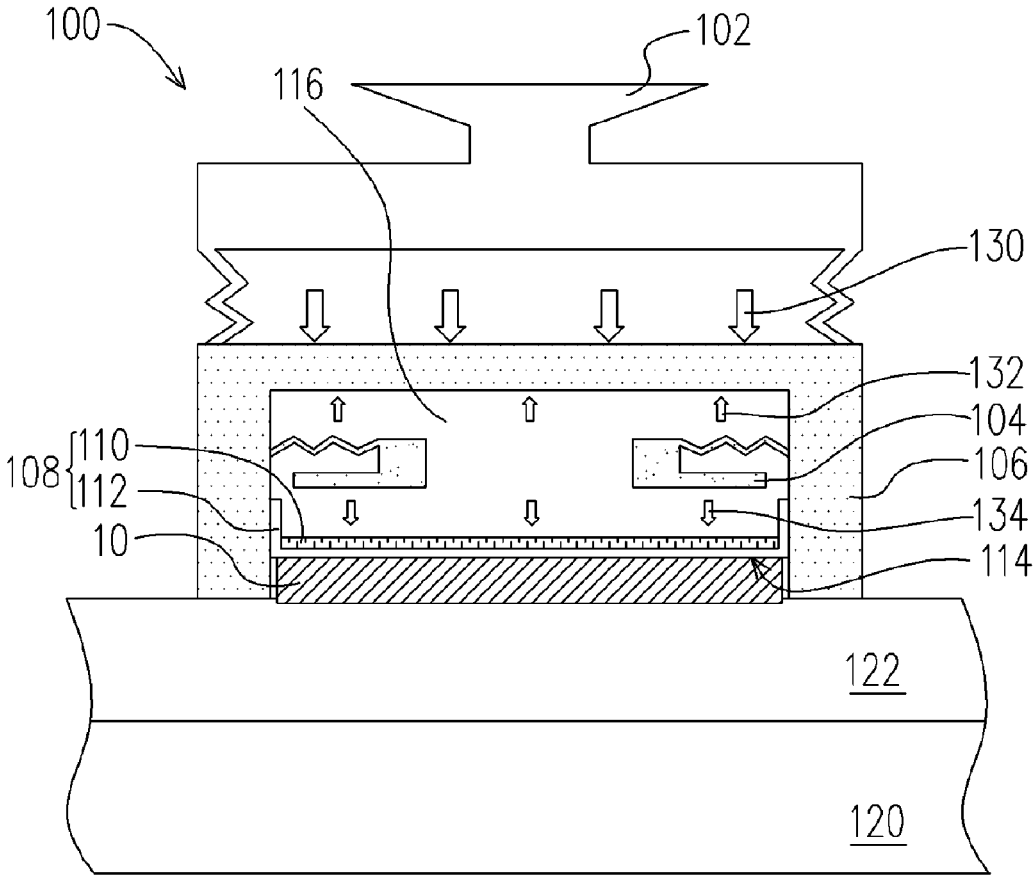
FIG. 1 (PRIOR ART)
FIG. 1 is a sectional view showing functional relationship of a polishing head and a wafer during a conventional CMP process.

The following description to the preferred embodiments of the present invention, as illustrated in the accompanied drawings, are set forth, for the purpose of explanation and not limitation, to provide a thorough understanding of the present invention.

Reference will now be made in detail to the embodiments of the invention, examples of which are illustrated in the accompanying drawings. Wherever possible, the same reference numbers are used in the drawings and the description to refer the same or like parts.

The dummy process according to an embodiment of the present invention is suitable for a chemical mechanical polishing (CMP) apparatus.

Figure 2A:
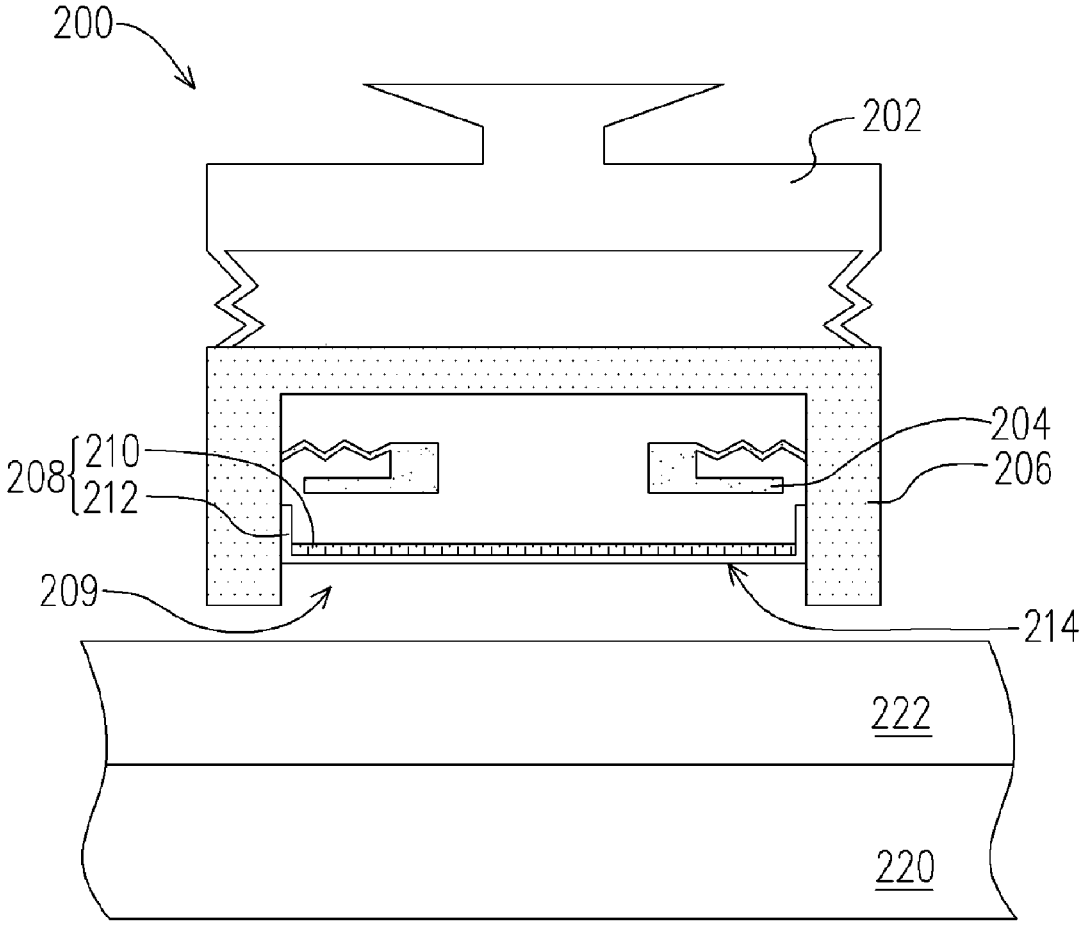
FIGS. 2A and 2B are sectional views showing functional relationship of a polishing head and a wafer during a dummy process according to a first embodiment of the present invention.
Figure 2B:
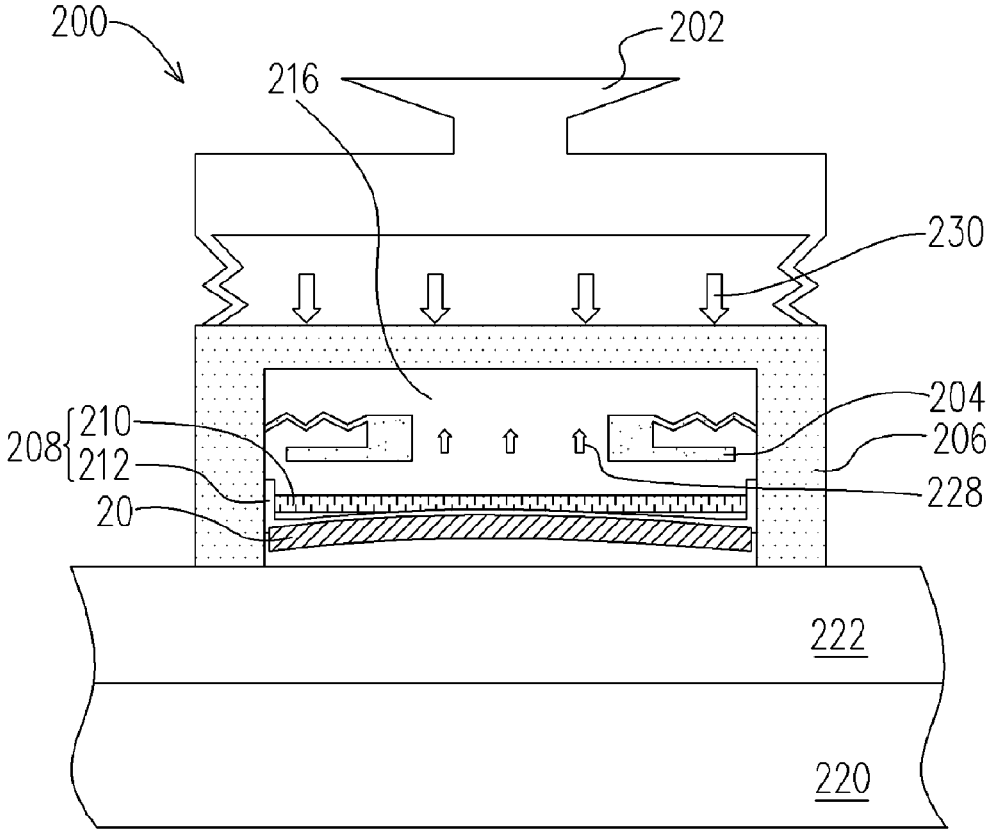

The first embodiment of the present invention is described with reference to FIGS. 2A and 2B. FIGS. 2A and 2B show functional relationship of a polishing head and a wafer during a dummy process. Referring to FIG. 2A, a CMP apparatus including a polishing head 200, a polishing table 220 and a polishing pad 222 is provided. The polishing pad 222 is disposed on the polishing table 220. The polishing head 200 includes a protective hood 202, a base 204, a retaining ring 206 and a wafer supporting assembly 208. The base 204 is below the protective hood 202, the retaining ring 206 is fixed around the rim of the base 204, the wafer supporting assembly 208 is located below and in a distance from the base 204, and a wafer receiving recess 209 is defined by an inner surface of the retaining ring 206 and the wafer supporting assembly 208. In addition, an external pump (not shown) can be connected to the polishing head 200 of the CMP apparatus to remove a fluid (e.g., a gas) from the polishing head 200. Further, it is to be noted that the drawing of CMP apparatus and parts thereof illustrated herein do not proportionally reflect a real CMP apparatus, and some detailed structures known to one of ordinary skill in the art have been omitted, such as, some channels for drawing or injecting fluids are usually disposed in the protective hood, the base 204, the retaining ring 206 and the wafer supporting assembly 208.

Referring again to FIG. 2A, the protective hood 202 in the polishing head 200 is usually in a circular shape, and the base 204 is a circular body below the protective hood 202, wherein the base 202 is made of rigid materials, such as alloy of aluminum, stainless steel, or tempered fabric plastics. There are channels (not shown) passing through the base 204 for attaching the wafer onto the wafer supporting assembly 208 under the base 204 are connected to a vacuum system to hold the wafer under suction. In addition, the wafer supporting assembly 208 includes, for example, a supporting board 210 and a flexible membrane 212 connected with the supporting board 210, while the membrane 212 is, for example, a high strength silicon membrane. The supporting board 210 comprises, for example, a plurality of holes (not shown) perpendicularly extending through the supporting board 210 is attached on one surface of the flexible membrane 212, and the flexible membrane 212 is connected to the retaining ring. The other surface of the flexible membrane 212 provides an attaching surface 214 for the wafer.

Referring to FIG. 2A, the retaining ring 206 of the polishing head 200 is a circular body having a flat bottom. When the base 204 is pushed down, the retaining ring 206 will be also pushed down to apply a load onto the surface of the polishing pad 222. Moreover, the retaining ring 206 can be made of a material such as hard plastics or porcelain.

Before carrying out a dummy process, referring to FIG. 2B, a wafer 20 is, for example, a dummy wafer or other sheet-like substrate suitable for protecting a wafer supporting assembly 208 is provided. Next, the wafer 20 is attached onto the attaching surface 214 in wafer receiving recess 209 as shown in FIG. 2A. Next, the supporting board 210 is pressed down such that the flexible membrane 210 faces the wafer 100 and a fluid-tight effect is created between the flexible membrane and the wafer.

Referring to FIG. 2B, the wafer supporting assembly 208 is moved up such that, for example, the hollow chamber 216 between the base 204 and the wafer supporting assembly 208 is under a negative pressure so that, the flexible membrane 212 is pushed up to keep the bottom surface of the maintaining ring 206 more protrusive than the bottom surface of the wafer 20. For example, the method to create a negative pressure within the hollow chamber 216 between the base 204 and the wafer supporting assembly 208 can be accomplished by using an external vacuum pump (not shown) attached to the polishing head 200, wherein pump is used to suck out the air from the hollow chamber 216 and thereby causing an upward force 228.

Again referring to FIG. 2B, the polishing head 200 is descended onto the polishing table 220 such that the base 204 is pressed downward by a force, for example, a downward force 230, to make the retaining ring fixed around the rim of the base 204 to contact the surface of the polishing pad 222 and the wafer 20 does not contact the surface of the polishing pad 222. Thereafter the polishing table 220 is rotated. Before the polishing table 220 is rotated, slurry containing abrasive particles can be supplied on the polishing pad 222.

In the present embodiment, since the positions of the retaining ring fixed on the rim of the base and the wafer are controlled in a manner that the retaining ring contacts the surface of the polishing pad and the wafer does not contact the surface of the polishing pad, and therefore the wafer can be used for a large number of dummy processes. In other words, the need of a large number of dummy wafers can be effectively avoided. Therefore, the overall production costs can be significantly reduced.

Figure 3:
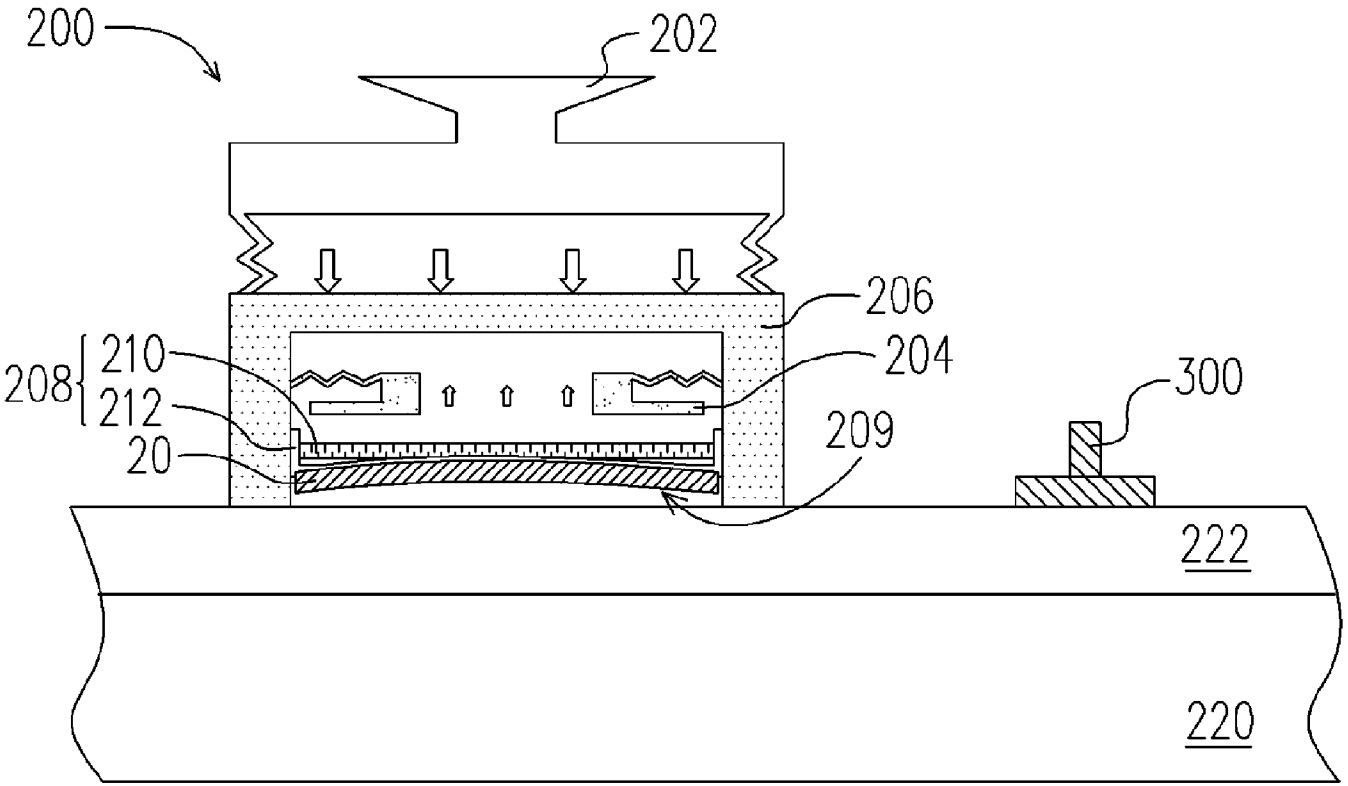
FIG. 3 is a sectional view showing functional relationship of a polishing head and a wafer during a conditioning process according to a second embodiment of the present invention.

According to another embodiment of the present invention, a polishing-pad conditioning method suitable for a CMP apparatus is provided. FIG. 3 shows a functional relationship of a polishing head and a wafer during a conditioning process of a CMP process according to a second embodiment of the present invention.

Referring to FIG. 3, the CMP polishing apparatus used in this embodiment is the same as that shown is FIG. 2A except for an additional use of a conditioner 300. Usually, when the CMP process is carried out for a certain period of time, a conditioning step will be performed for conditioning the polishing pad 222. Before performing the conditioning steps, a wafer 20 is attached to the attaching surface 212 in the wafer receiving recess 209. Then, the wafer supporting assembly 208 is moved up to make the bottom surface of the retaining ring 206 more protrusive than the bottom surface of the wafer 20. The polishing head 200 and the conditioner 300 are then moved onto the polishing table 220 such that the conditioner 300 is made to contact the surface of the polishing pad 222. Next, the base 204 of the polishing head 200 is pressed down such that the retaining ring 206 contacts the surface of the polishing pad 222 and the wafer 20 does not contact the surface of the polishing pad 222. Thereafter, the polishing table 220 is rotated for conditioning the contour of the polishing pad 222.

In the present embodiment, since the positions of the retaining ring fixed on the rim of the base and the wafer are controlled in a manner that the retaining ring contacts the polishing pad and the wafer does not contact the surface of the polishing pad, the wafer can be used for a large number of polishing-pad conditioning processes. In other words, a need for a large number of dummy wafers can be effectively avoided. Therefore, the overall production costs can be significantly reduced.

Figure 4:
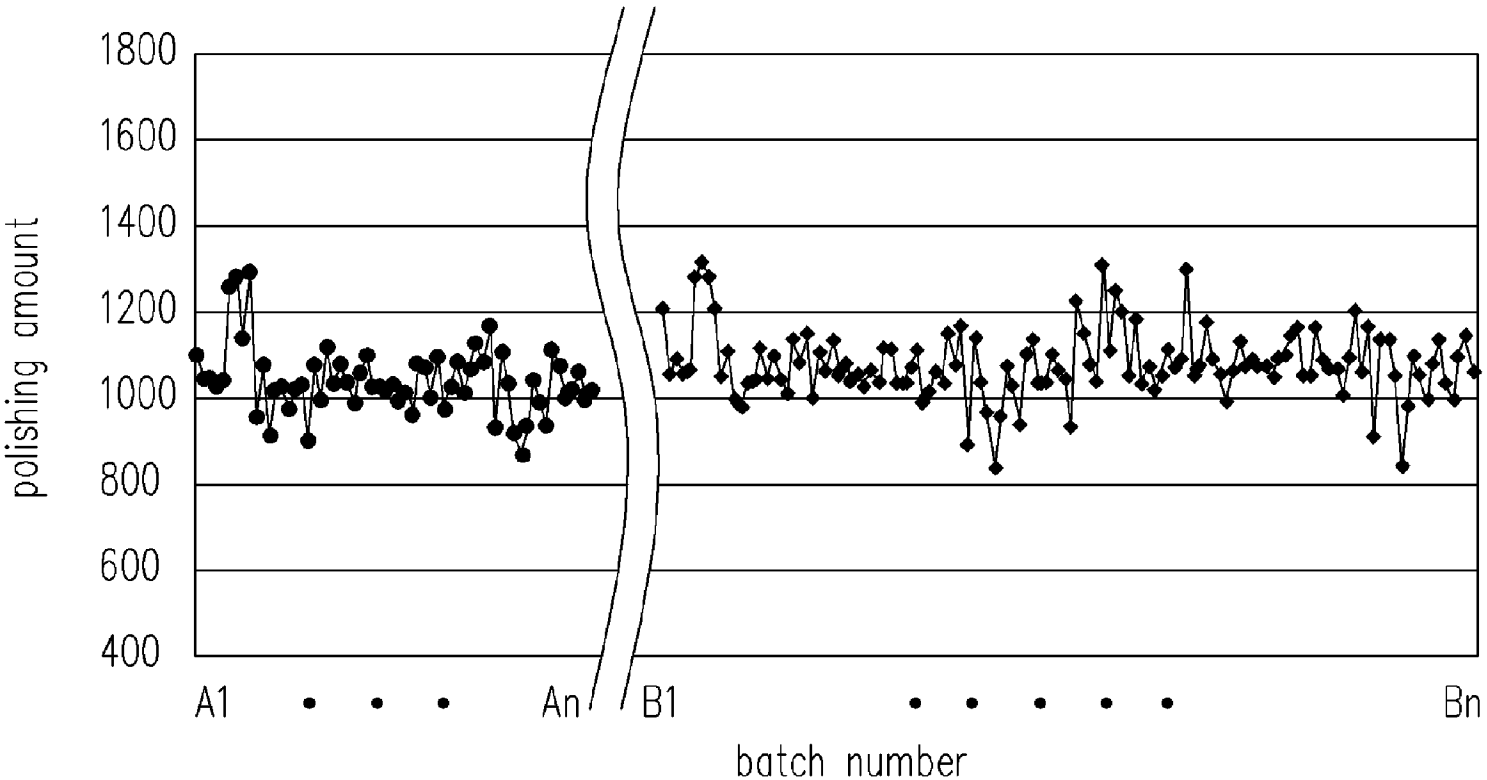
FIG. 4 is a graph showing curves of batch number versus polishing amount of a process of fabricating a shallow-trench isolation after a dummy process in conjunction with a regular CMP process according to an embodiment of the present invention.

To show the effectiveness of the present invention, an experiment was carried out to study the effect of the dummy process of the present invention and the conventional dummy process and these effects were compared. In the above study, the CMP apparatus is configured in a manner described above to carry out the dummy process of the present invention and after the dummy process, the CMP apparatus is then used for fabricating a shallow trench isolation structure for a number of batches, and the CMP apparatus is configured in a manner to carry out the conventional dummy process and after the conventional dummy process, the CMP apparatus is then used for fabricating a shallow trench isolation structure for a number of batches. FIG. 4 illustrates a curve showing number of batches versus the amount of polishing slurry required for fabricating the shallow-trench isolation structure after the dummy process according to the present invention and the conventional dummy process were performed. Referring to FIG. 4, the amount of polishing slurry used for fabricating the shallow trench isolation structure is plotted along the y-axis, and the batch numbers, A1~An indicating batch numbers after the dummy process of this invention and B1~Bn indicating batch numbers after the conventional dummy are plotted along the x-axis. In the CMP process operating parameters, for example, the pressure of the retaining ring was set between 0.5~15 psi, the flow rate of the polishing slurry was set between 50~500 mL/min, and the rotation rate of the polishing pad was between 10–200 rpm. Accordingly, it could be inferred from FIG. 4 that, the amount of slurry required by the number An number of batches is almost same compared to the amount of slurry required by the Bn number of batches. Thus, the dummy process of the present invention can be practically applied.

In summary, since the positions of the retaining ring fixed on the rim of the base and the wafer are controlled in a manner that the retaining ring contacts the polishing pad and the wafer does not contact the surface of the polishing pad, and therefore a single wafer can be used for a large number of dummy or polishing-pad conditioning processes. In other words, of the need of a large number of dummy wafers for the dummy or the polishing-pad conditioning processes can be effectively avoided. Therefore, the overall production costs can be significantly reduced.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. A dummy process, suitable for a chemical mechanical polishing (CMP) apparatus including a polishing head, a polishing table, and a polishing pad, wherein the polishing pad is disposed on the polishing table, the polishing head comprises a protective hood, a base, a retaining ring and a wafer supporting assembly, and wherein the base is below the protective hood, the retaining ring is fixed around a rim of the base, the wafer supporting assembly is located below and in a distance from the base, and a wafer receiving recess is defined by an inner surface of the retaining ring and the wafer supporting assembly, the dummy process comprising:

providing a wafer;

attaching the wafer onto the wafer receiving recess;

moving up the wafer supporting assembly to make the bottom surface of the retaining ring more protrusive than the bottom surface of the wafer;

moving the polishing head onto the polishing table;

pressing down the base such that the retaining ring contacts a surface of the polishing pad and the wafer does not contact the surface of the polishing pad; and rotating the polishing table.

2. The dummy process as recited in claim 1, wherein the wafer is a dummy wafer.

3. The dummy process as recited in claim 1, wherein the wafer supporting assembly comprises a supporting board and a flexible membrane, the supporting board has a plurality of holes perpendicularly extending through the supporting board, and the flexible membrane is connected to and extends under the supporting board to provide an attaching surface for the wafer.

4. The dummy process as recited in claim 3, wherein the step of attaching the wafer includes attaching the wafer to an attaching surface of the flexible membrane.

5. The dummy process as recited in claim 3, wherein the step of moving up the wafer supporting assembly comprises creating a negative pressure within a hollow chamber between the base and the wafer supporting assembly such that an upward force is applied onto the flexible membrane.

6. The dummy process as recited in claim 5, wherein the CMP apparatus further comprises a pump connected externally with the polishing head.

7. The dummy process as recited in claim 6, wherein the step of creating a negative pressure within the hollow chamber further comprises using the pump to draw out gases from the chamber.

8. The dummy process as recited in claim 1, wherein, before the step of rotating the polishing table, further comprising a step of adding polishing slurry on the polishing pad.

9. A polishing-pad conditioning process, suitable for a CMP apparatus including conditioner, a polishing head, a polishing table, and a polishing pad, wherein the polishing pad is disposed on the polishing table, the polishing head comprises a protective hood, a base, a retaining ring and a wafer supporting assembly, and wherein the base is below the protective hood, the retaining ring is fixed around a rim of the base, the wafer supporting assembly is located below and in a distance from the base, and a wafer receiving recess is defined by an inner surface of the retaining ring and the wafer supporting assembly, the polishing-pad conditioning comprising:

attaching a wafer onto the wafer receiving recess;

moving up the wafer supporting assembly to make the bottom surface of the retaining ring more protrusive than the bottom surface of the wafer;

moving the polishing head onto the polishing table;

pressing down the base such that the retaining ring contacts a surface of the polishing pad and the wafer does not contact the surface of the polishing pad; and rotating the polishing table for conditioning contour of the polishing pad.

10. The polishing-pad conditioning process as recited in claim 9, wherein the wafer is a dummy wafer.

11. The polishing-pad conditioning process as recited in claim 9, wherein the wafer supporting assembly comprises a supporting board and a flexible membrane, the supporting board has a plurality of holes perpendicularly extending through the supporting board, and the flexible membrane is connected to and extends under the supporting board to provide an attaching surface for the wafer.

12. The polishing-pad conditioning process as recited in claim 11, wherein the step of attaching the wafer includes attaching the wafer to an attaching surface of the flexible membrane.

13. The polishing-pad conditioning process as recited in claim 11, wherein the step of moving up the wafer supporting assembly comprises creating a negative pressure within a hollow chamber between the base and the wafer supporting assembly such that an upward force is applied onto the flexible membrane.

14. The polishing-pad conditioning process as recited in claim 13, wherein the CMP apparatus further comprises a pump connected externally with the polishing head.

15. The polishing-pad conditioning method as recited in claim 14, wherein the step of creating a negative pressure within the hollow chamber further comprises using the pump to draw out gases from the chamber.

16. The polishing-pad conditioning process as recited in claim 9, wherein, before the step of rotating the polishing table, further comprising a step of adding polishing slurry on the polishing pad.

* * * * *